US011059308B2

(12) United States Patent
Ido et al.

(10) Patent No.: US 11,059,308 B2
(45) Date of Patent: Jul. 13, 2021

(54) LIQUID DISCHARGING APPARATUS AND METHOD FOR REPLACING DISCHARGING UNIT

(71) Applicant: Seiko Epson Corporation, Tokyo (JP)

(72) Inventors: Masahiro Ido, Azumino (JP); Kenji Kojima, Nagano (JP); Masaru Jingushi, Nagano (JP); Seigo Mizutani, Matsumoto (JP); Takahiro Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 266 days.

(21) Appl. No.: 16/304,046

(22) PCT Filed: May 17, 2017

(86) PCT No.: PCT/JP2017/018547
§ 371 (c)(1),
(2) Date: Nov. 21, 2018

(87) PCT Pub. No.: WO2017/204056
PCT Pub. Date: Nov. 30, 2017

(65) Prior Publication Data

US 2020/0324562 A1 Oct. 15, 2020

(30) Foreign Application Priority Data

May 25, 2016 (JP) ..... JP2016-103980

(51) Int. Cl.
*B41J 2/175* (2006.01)
*B41J 25/34* (2006.01)
*B41J 3/54* (2006.01)

(52) U.S. Cl.
CPC ..... *B41J 25/34* (2013.01); *B41J 2/1752* (2013.01); *B41J 3/543* (2013.01)

(58) Field of Classification Search
CPC ..... B41J 25/34; B41J 3/543; B41J 2/1752
See application file for complete search history.

(56) References Cited

U.S. PATENT DOCUMENTS 6,328,415 B1 12/2001 Norton et al.
9,174,447 B2 * 11/2015 Sugahara ..... B41J 2/17553
(Continued)

FOREIGN PATENT DOCUMENTS

EP 1256457 11/2002
JP 2001-038893 * 2/2001 ..... B41J 2/01
(Continued)

OTHER PUBLICATIONS

Google translation of JP 2001-038893, published on Feb. 2001. (Year: 2001).*

(Continued)

*Primary Examiner* — Huan H Tran
(74) *Attorney, Agent, or Firm* — Workman Nydegger

(57) ABSTRACT

A liquid discharging apparatus 1 includes a carriage 2 configured to reciprocate relative to a medium, and a plurality of discharging units 4 attached to the carriage 2 and configured to discharge liquid onto the medium. At a plurality of replacement positions in a reciprocation direction B of the carriage 2, the carriage 2 allows the plurality of discharging units 4 to be replaced. At the plurality of replacement positions for the carriage 2, a discharging unit to be replaced, among the plurality of discharging units, is accessible from downstream in a discharge direction C of the liquid.

5 Claims, 6 Drawing Sheets

(56) References Cited

U.S. PATENT DOCUMENTS

| | | | |
|---|---|---|---|
| 9,573,375 | B2 | 2/2017 | Murayama |
| 2005/0168518 | A1 | 8/2005 | Nishino |
| 2006/0238567 | A1 | 10/2006 | Sekino et al. |
| 2016/0031220 | A1 | 2/2016 | Murayama |

FOREIGN PATENT DOCUMENTS

| | | | | | |
|---|---|---|---|---|---|
| JP | 2001-232785 | | * | 8/2001 | ..... B41J 2/01 |
| JP | 2001-232785 | A | | 8/2001 | |
| JP | 2007-237446 | | * | 9/2007 | ..... B41J 2/01 |
| JP | 2007-237446 | A | | 9/2007 | |
| JP | 2007-245353 | | * | 9/2007 | ..... B41J 2/01 |
| JP | 2007-245353 | A | | 9/2007 | |
| JP | 2008-279694 | A | | 11/2008 | |
| JP | 2010-194920 | A | | 9/2010 | |
| JP | 2010-201674 | | | 9/2010 | |
| JP | 2013-075361 | A | | 4/2013 | |
| JP | 2015-120307 | A | | 7/2015 | |
| JP | 2015-166153 | A | | 9/2015 | |
| JP | 2016-032890 | | | 3/2016 | |
| WO | 20130146246 | | | 10/2013 | |

OTHER PUBLICATIONS

Google translation of JP 2001-232785, published on Aug. 2001 (Year: 2001).*

Google translation of JP 2007-237446, published on Sep. 2007 (Year: 2007).*

Google translation of JP 245353, published on Sep. 2007 (Year: 2007).*

International Search Report cited in PCT/JP2017/018547, dated Jul. 4, 2017.

European Search Report issued in Application No. EP17802648 dated Dec. 2, 2019.

* cited by examiner

LIQUID DISCHARGING APPARATUS AND METHOD FOR REPLACING DISCHARGING UNIT

TECHNICAL FIELD

The invention relates to a liquid discharging apparatus and a method for replacing a discharging unit.

BACKGROUND ART

For example, as disclosed in PTL 1 to PTL 3, various liquid discharging apparatuses including a discharging unit configured to discharge liquid have been used. As illustrated in PTL 1 and PTL 2, a liquid discharging apparatus including a carriage configured to reciprocate relative to a medium and a discharging unit attached to the carriage and configured to discharge liquid onto the medium is often used. As illustrated in PTL 3, in a large-sized liquid discharging apparatus, for example, a carriage is often provided with a plurality of discharging units.

CITATION LIST

Patent Literature

[PTL 1] JP-A-2013-75361
[PTL 2] JP-A-2015-166153
[PTL 3] JP-A-2007-237446

SUMMARY OF INVENTION

Technical Problem

In a large-sized liquid discharging apparatus including a carriage provided with a plurality of discharging units, for example, when a failure occurs in one of the plurality of discharging units, the discharging unit in which the failure occurred is replaced. However, in the large-sized liquid discharging apparatus, for example, since the apparatus is large and the carriage is also large, an operator sometimes faces difficulty in reaching a discharging unit to be replaced, for example, resulting in a great burden in replacing the discharging unit in which the failure occurred.

An advantage of the invention is to reduce the burden in replacing a discharging unit on a carriage attachable with a plurality of discharging units.

Solution to Problem

To address the issue described above, a liquid discharging apparatus according to a first aspect of the invention includes a carriage configured to reciprocate relative to a medium, and a plurality of discharging units attached to the carriage and configured to discharge liquid onto the medium. At a plurality of replacement positions in a reciprocation direction of the carriage, the carriage allows the plurality of discharging units to be replaced. At the plurality of replacement positions for the carriage, a discharging unit to be replaced, among the plurality of discharging units, is accessible from a downstream side in a discharge direction of the liquid.

According to the aspect, at the plurality of replacement positions in the reciprocation direction, the carriage allows a discharging unit to be replaced. At the replacement positions for the carriage, the discharging unit to be replaced is accessible from the downstream side in the discharge direction of the liquid. With this configuration, the discharging unit can be replaced at either of the replacement positions, whichever allows easy replacement. By accessing the discharging unit from the downstream side in the discharge direction of the liquid, the discharging unit is accessible from either of the positions, where obstructing parts are few. Therefore, in the carriage attachable with the plurality of discharging units, a burden in replacing the discharging unit can be reduced.

Note that, "the discharging unit to be replaced is accessible from the downstream side in the discharge direction of the liquid" refers to both a case when the discharging unit to be replaced is accessible from the downstream side in the discharge direction of the liquid, and a case when the discharging unit to be replaced is accessible from a direction other than from the downstream side in the discharge direction of the liquid.

A liquid discharging apparatus according to a second aspect of the invention is configured that, in the first aspect, the plurality of replacement positions are provided on both sides in the reciprocation direction with respect to a center part within a reciprocation range of the carriage.

According to the aspect, the replacement positions are provided on both sides in the reciprocation direction with respect to the center part within the reciprocation range of the carriage. That is, the replacement positions are provided adjacent to both ends in the reciprocation direction, for example. With this configuration, the discharging parts are accessible from either of the positions, where obstructing parts are few, particularly effectively reducing a burden in replacing the discharging unit.

A liquid discharging apparatus according to a third aspect of the invention is configured that, in the first aspect or the second aspect, at the replacement positions for the carriage, at least one of parts in a position facing the plurality of discharging units is movable.

According to the aspect, at the plurality of replacement positions for the carriage, at least one part of the parts in a position facing the discharging units is movable. With this configuration, when the discharging units are to be replaced, a burden in replacing the discharging units can be reduced by moving the part. When the discharging units are not to be replaced, the part can be arranged at a position facing the discharging units, achieving space saving.

A liquid discharging apparatus according to a fourth aspect of the invention is configured that, in the third aspect, a number of the plurality of discharging units that are replaceable at a replacement position, where the part that is movable is present, among the plurality of replacement positions is greater than a number of the plurality of discharging units that are replaceable at a replacement position, where the part that is movable is not present, among the plurality of replacement positions.

According to the aspect, the number of replaceable discharging units at the replacement position where the part that is movable is present is greater than the number of replaceable discharging units at the replacement position where the part that is movable is not present. By increasing the number of replaceable discharging units at the replacement position where the part that is movable is present to be greater than the number of replaceable discharging units at the replacement position where the part that is movable is not present, the reciprocation range of the carriage can be shortened. With this configuration, space saving can be effectively achieved in the apparatus.

A liquid discharging apparatus according to a fifth aspect of the invention is configured that, in any one of the first aspect to the fourth aspect, the carriage allows the discharging units to be detached and attached from an upstream side in the discharge direction of the liquid, and allows the discharging units to be secured from the downstream side in the discharge direction of the liquid.

According to the aspect, the carriage allows the discharging units to be secured from the downstream side in the discharge direction of the liquid. In the discharging units, members, such as flow channels for the liquid, are formed on the upstream side in the discharge direction of the liquid. However, without being obstructed by the members, the discharging units can be secured. According to the aspect, the discharging units can be detached and attached from the upstream side in the discharge direction of the liquid. With the configuration described above, the discharging units can be easily arranged in a highly dense manner, effectively achieving space saving in the apparatus.

A method for replacing a discharging unit, according to a sixth aspect of the invention, for a liquid discharging apparatus including a carriage configured to reciprocate relative to a medium, and a plurality of discharging units attached to the carriage and configured to discharge liquid onto the medium, includes moving the carriage to a first replacement position to allow accessing to some of the discharging units from a downstream side in a discharge direction of the liquid for replacement, and moving the carriage to a second replacement position different from the first replacement position to allow accessing to some of the discharging units from the downstream side in the discharge direction of the liquid for replacement.

According to the aspect, the carriage is moved to the first replacement position to allow accessing to some of the discharging units from the downstream side in the discharge direction of the liquid for replacement. The carriage is moved to the second replacement position different from the first replacement position to allow accessing to some of the discharging units from the downstream side in the discharge direction of the liquid for replacement. With this configuration, the discharging units can be replaced at either of the first replacement position and the second replacement position, whichever allows easy replacement. By accessing the discharging units from the downstream side in the discharge direction of the liquid, the discharging units are accessible from either of the positions, where obstructing parts are few. Therefore, in the carriage attachable with the plurality of discharging units, a burden in replacing the discharging unit can be reduced.

In a method for replacing a discharging unit, according to a seventh aspect of the invention, in the sixth aspect, when the carriage is at the first replacement position, at least one of parts in a position facing the discharging units is movable. A number of the plurality of discharging units to be replaced at the first replacement position is greater than a number of the plurality of discharging units to be replaced at the second replacement position.

According to the aspect, when the carriage is at the first replacement position, at least one part of the parts in a position facing the discharging units is movable. The number of the plurality of discharging units to be replaced, at the first replacement position is greater than the number of the plurality of discharging units to be replaced at the second replacement position. That is, by increasing the number of replaceable discharging units at the replacement position where the part that is movable is present to be greater than the number of replaceable discharging units at the replacement position where the part that is movable is not present, the reciprocation range of the carriage can be shortened. With this configuration, space saving can be effectively achieved in the apparatus.

In a method for replacing a discharging unit, according to an eighth aspect of the invention, in the sixth aspect or the seventh aspect, at the first replacement position and the second replacement position, the plurality of discharging units are detached and attached from an upstream side in the discharge direction of the liquid, and the discharging units are secured from the downstream side in the discharge direction of the liquid.

According to the aspect, by securing the discharging units from the downstream side in the discharge direction of the liquid, the discharging units can be secured without being obstructed by members on the upstream side in the discharge direction of the liquid. In the apparatus allowing the discharging units to be detached and attached from the upstream side in the discharge direction of the liquid, the discharging units can be easily arranged in a highly dense manner, effectively achieving space saving in the apparatus.

DESCRIPTION OF EMBODIMENTS

A recording device according to an example of the invention will be described herein in detail, as a liquid discharging apparatus, with reference to the appended drawings.

Figure 1:
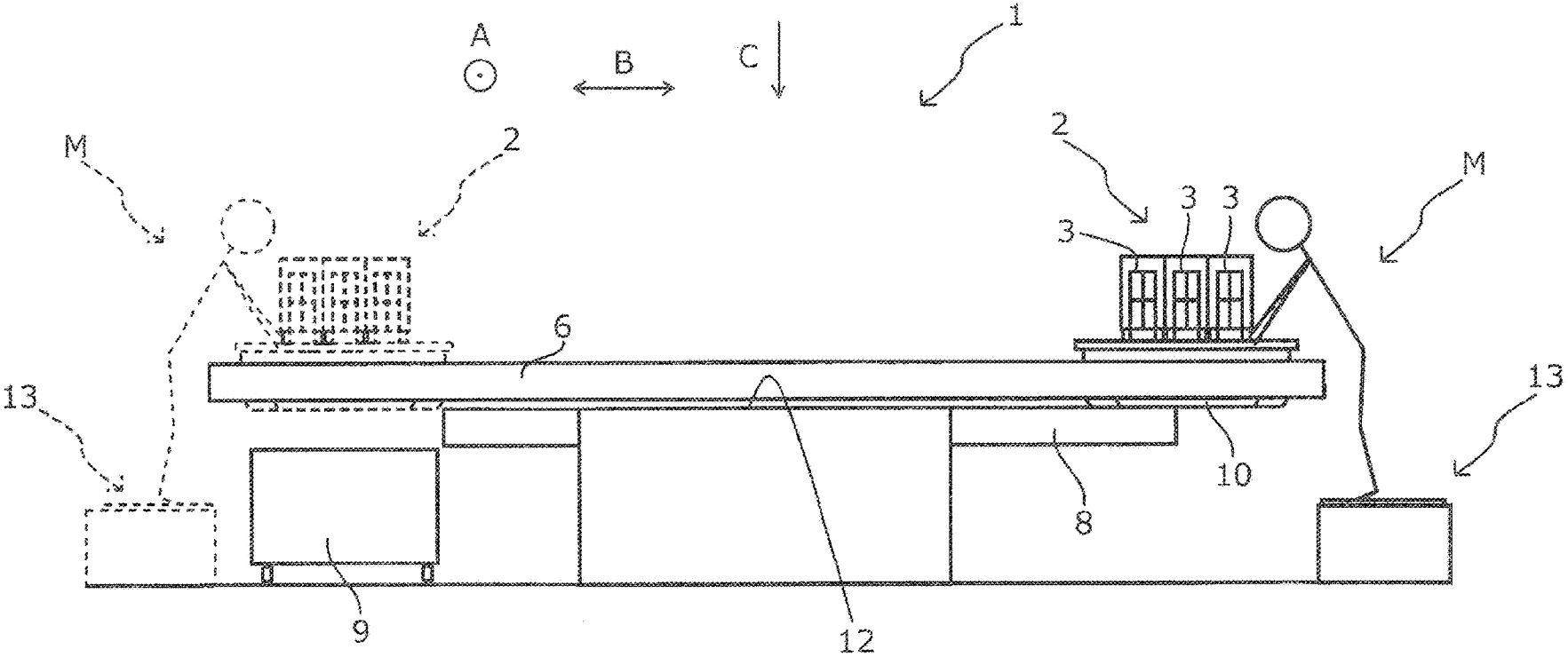
FIG. 1 is a schematic front view illustrating a recording device according to an example of the invention.
Figure 2:
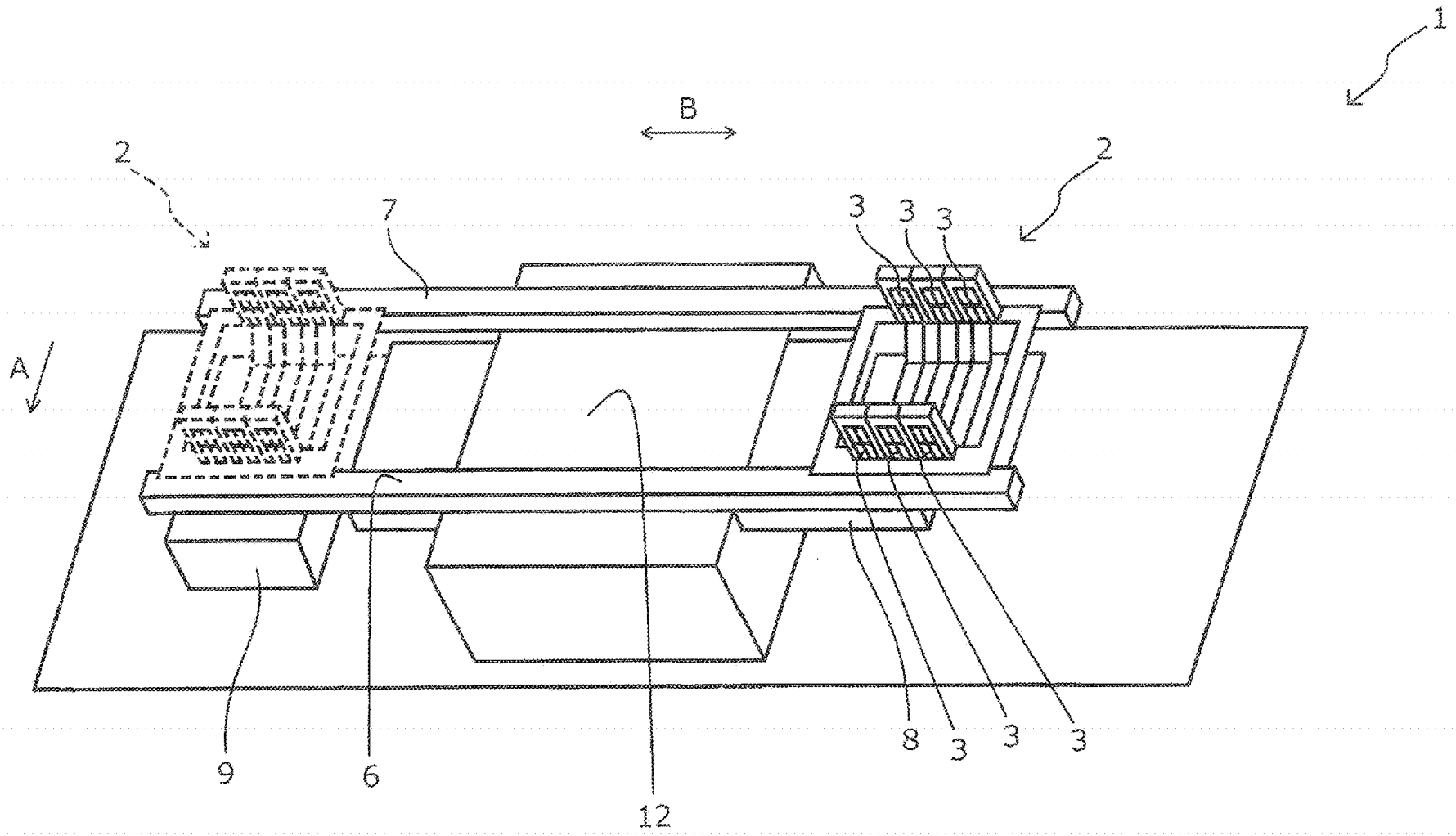
FIG. 2 is a schematic perspective view illustrating a recording device according to an example of the invention.
Figure 3:
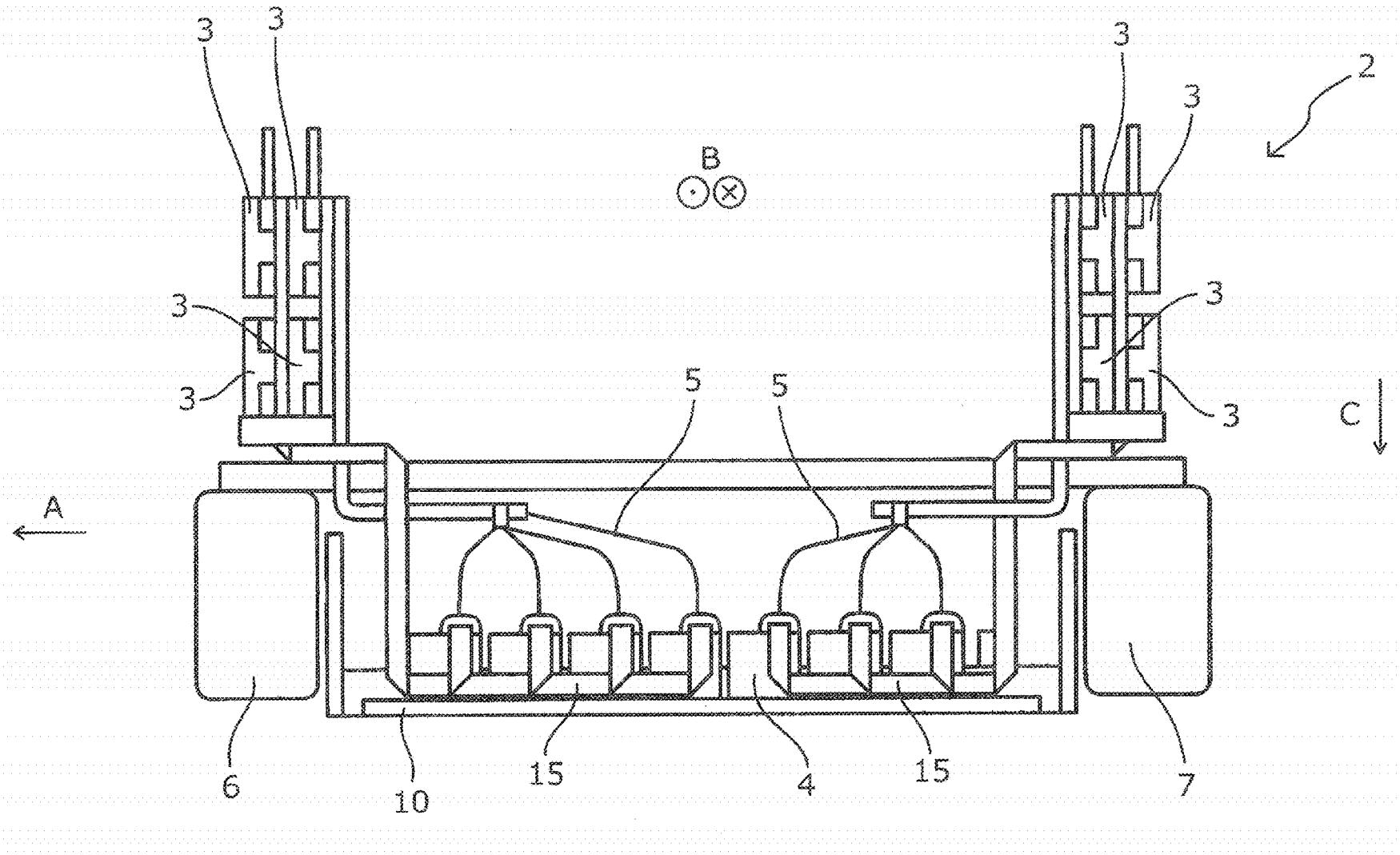
FIG. 3 is a schematic side view illustrating a main part of a recording device according to an example of the invention.
Figure 4:
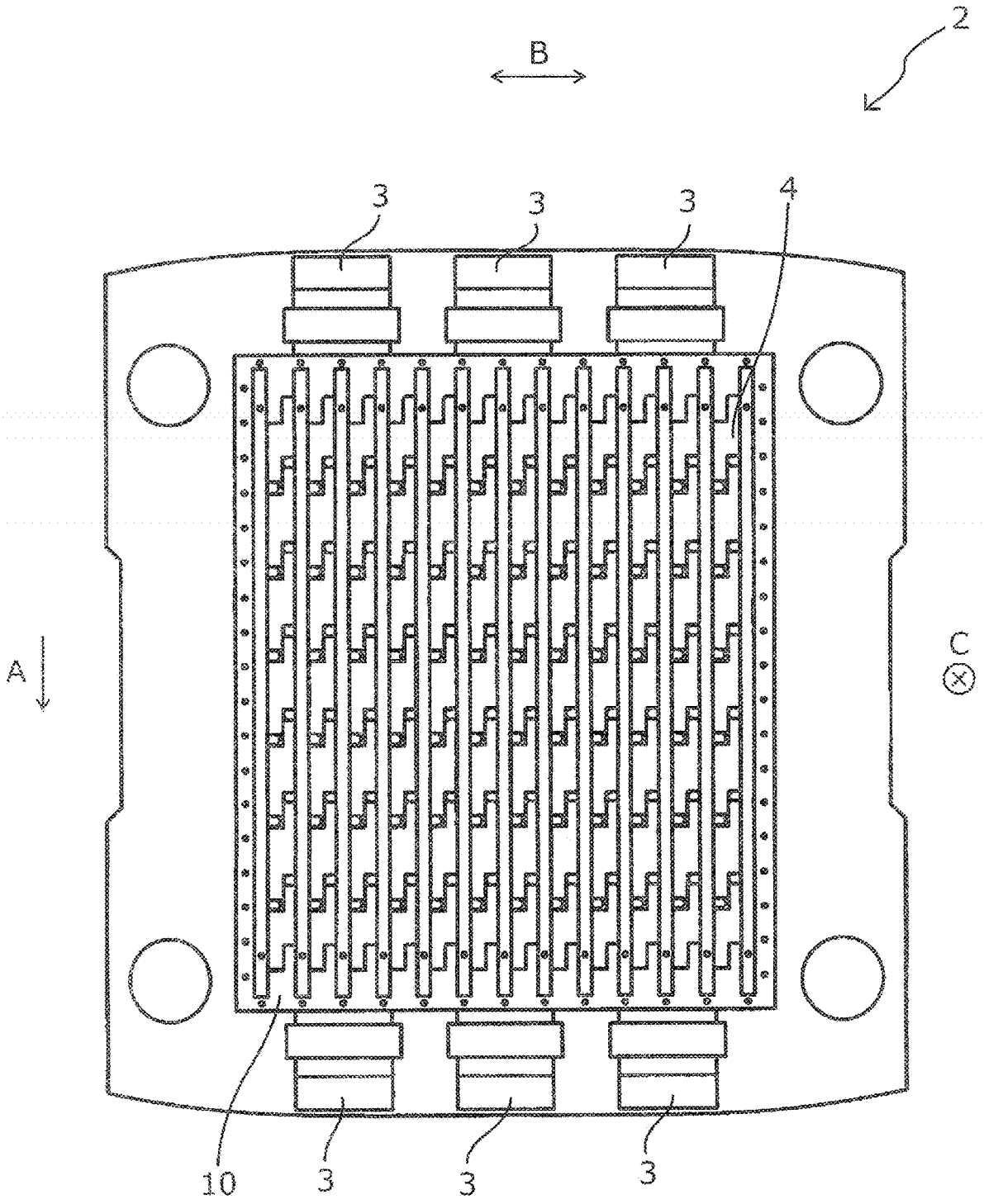
FIG. 4 is a schematic plan view illustrating a main part of a recording device according to an example of the invention.
Figure 5:
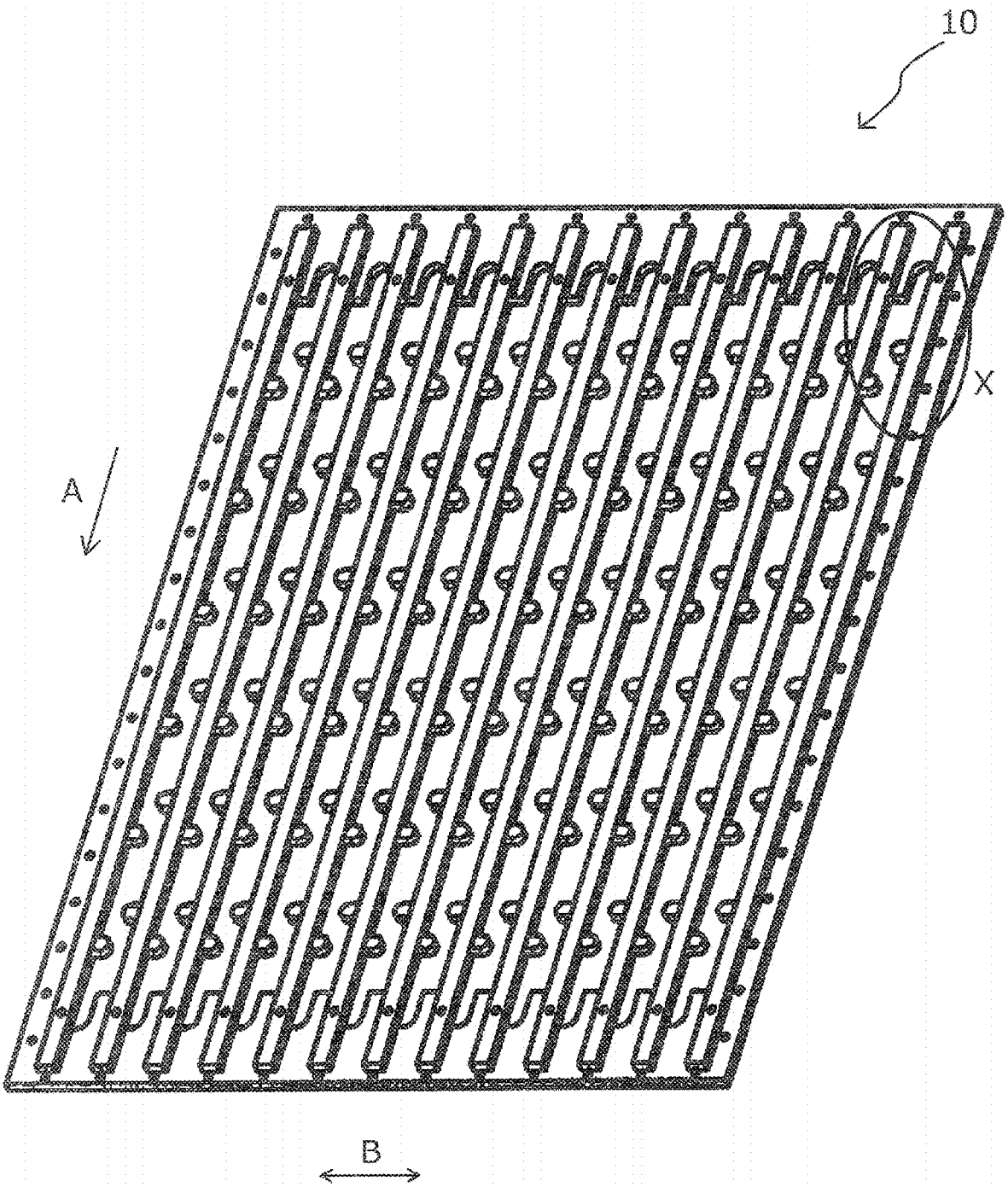
FIG. 5 is a schematic perspective view illustrating a main part of a recording device according to an example of the invention.
Figure 6:
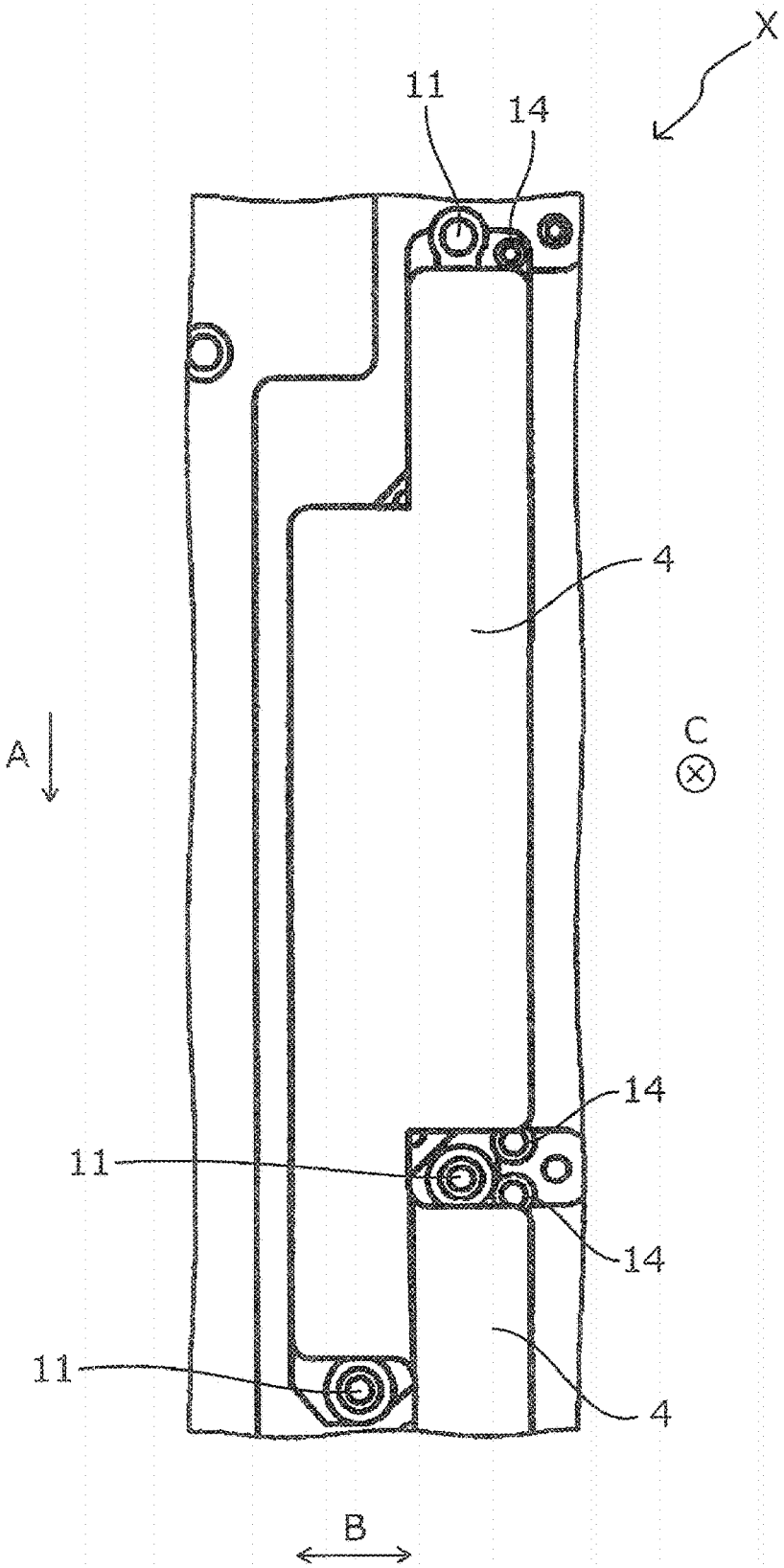
FIG. 6 is a schematic plan view illustrating a main part of a recording device according to an example of the invention.

FIG. 1 is a schematic front view of a recording device 1 according to the example. FIG. 2 is a schematic perspective view of the recording device 1 according to the example. FIG. 3 is a schematic side view of a carriage 2 representing a main part of the recording device 1 according to the example. FIG. 4 is a schematic plan view of the carriage 2 representing the main part of the recording device 1 according to the example. FIG. 5 is a schematic perspective view of a head mount 10 configuring the carriage 2 representing the main part of the recording device 1 according to the example. FIG. 6 is a schematic plan view of a state when a recording head 4 is mounted on the head mount 10, represented by a region X in FIG. 5. In FIGS. 1 to 6, some constituent elements are omitted for ease of understanding of an overview of the recording device 1 according to the example.

The recording device 1 according to the example is configured to allow a support part 12 (see FIGS. 1 and 2) to support a medium for recording, and to allow a transporting mechanism (not illustrated) to transport the medium in a transporting direction A. By discharging ink, i.e., an example of a liquid, from the recording heads 4 serving as a plurality of discharging units attached to the carriage 2 onto the medium supported by the support part 12 and transported in the transporting direction A, an image can be formed onto the medium. When the recording device 1 according to the example is placed on a horizontal surface, a discharging direction C of the ink in the recording device 1 is a vertically downward direction.

The carriage 2 can reciprocate along guide rails 6 and 7 in a reciprocation direction B intersecting with the transporting direction A. When the image is to be formed (recorded) onto the medium, as the recording head 4 discharges the ink, the recording device 1 according to the example moves the carriage 2 in the reciprocation direction B, and transports the medium in the transporting direction A, alternately. In other words, when the image is to be formed onto the medium, the medium is intermittently transported, as the carriage 2 reciprocates.

The medium may be a printing-target material. The printing-target material refers to a subject of printing, such as fiber, garments, and other cloth products. Fiber includes woven cloth, knit fabric, and non-woven cloth, for example, made of natural fiber such as cotton, hemp, silk, and wool, of chemical fiber such as nylon, and of composite fiber of natural fiber and chemical fiber. Garments and other cloth products include fabricated products, such as a T-shirt, handkerchief, scarf, towel, handbag, fabric bag, and furniture-related products including a curtain, sheet, and bed cover, as well as include fiber before and after cutting to serve as parts before fabrication.

In addition to the printing-target materials described above, the medium may be special paper for ink-jet recording, such as plain paper, pure paper, and glossy paper. The medium may also be, for example, a plastic film not having undergone surface treatment for ink-jet printing (i.e., not formed with an ink absorption layer), as well as one coated with a plastic material on a base material, such as paper, and one adhered with a plastic film. Such a plastic material may be, but not limited to, for example, polyvinyl chloride, polyethylene terephthalate, polycarbonate, polystyrene, polyurethane, polyethylene, and polypropylene.

As illustrated in FIGS. 1 and 2, a maintenance part 8 is provided on a side (home position side) in the reciprocation direction B. With the maintenance part 8, a cap, a suction mechanism, and a wiper (not illustrated), for example, can be used to execute, when the carriage 2 is at a maintenance position (a home position representing a position facing the maintenance part 8), attaching of the cap to the recording head 4, sucking of the ink from an ink discharge nozzle arranged on the recording head 4, and wiping of the recording head 4, for example.

As illustrated in FIGS. 1 and 2, provided on an opposite side to the home position side in the reciprocation direction B is an ink cartridge set part 9 configured to be set with an ink cartridge accommodating the ink to be discharged from the recording head 4 onto the medium. As illustrated in FIG. 3, tubes 15 couple the ink cartridge set part 9 and recording heads 4. The tubes 15 are flexible. The ink cartridge set part 9 can be moved from a position illustrated in FIGS. 1 and 2. That is, when the carriage 2 is moved to the opposite side to the home position side in the reciprocation direction B, a space in a lower portion of the recording device 1 according to the example can be provided.

As illustrated in FIG. 3, the carriage 2 according to the example can be mounted with a plurality of the recording heads 4. Even in this case, the recording heads 4 are each coupled to ink cartridges being set in the ink cartridge set part 9 with a plurality of the tubes 15. The recording heads 4 are each coupled to driving substrates 3 of the recording heads 4 with flexible flat cables (FFC), i.e., the cables 5. As illustrated in FIG. 3, the cables 5 are arranged from the driving substrates 3 to the head mount 10, and are each coupled, via a position on a side surface of the recording heads 4, to each of the recording heads 4. In the example, as the position on the side surface of the recording heads 4, the cables 5 are coupled to each of the recording heads 4 from the side surface (front in FIG. 3) alone when viewed from a direction along the transporting direction A. However, the invention is not limited to the configuration described above. Coupling to each of the recording heads 4 may be made from the side surface and an opposite side surface (front and back in FIG. 3) when viewed in the direction along the transporting direction A.

As illustrated in FIGS. 3 and 4, the carriage 2 according to the example can be mounted with the plurality of recording heads 4. With this configuration, in the recording device 1 according to the example, when a failure occurs in some of the plurality of recording heads 4, only the recording heads 4 which have the failure can be replaced. The recording heads 4 are each attached to the head mount 10 illustrated in FIG. 5.

When replacing the recording heads 4, an operator M puts the recording heads 4 in place at predetermined positions on the head mount 10 from above (upstream side in the discharging direction C) the head mount 10, and then screws and secures the recording heads 4 onto the head mount 10 from below (downstream side in the discharging direction C) the head mount 10. Specifically, as illustrated in FIG. 6, a plurality of positioning pins 14 configured to position the recording heads 4 are formed on the head mount 10. The recording head 4 for replacement is placed on a position determined by the positioning pins 14 from above. The recording head for replacement is then screwed and secured onto the head mount 10 with screw stoppers 11 from below. That is, when replacing the recording heads 4, the operator M detaches and attaches the recording heads 4 from the upstream side in the discharging direction C, and then secures the recording heads 4 from the downstream side in the discharging direction C.

Two replacement positions (i.e., a plurality of replacement positions) are provided for the recording heads 4. A position (home position side) for the carriage 2 is represented by solid lines in FIGS. 1 and 2. A position (opposite side to the home position side) for the carriage 2 is represented by dashed lines in FIGS. 1 and 2. FIG. 1 illustrates a state where the operator M is standing on a step 13, and putting the recording heads 4 in place onto the head mount 10 from above. As illustrated in FIG. 1, the recording device 1 according to the example is great in size relative to the operator M. With this configuration, when a single replacement position is provided for the recording heads 4, replacing a recording head 4 placed on a back side as viewed from a position of the operator M involves a great burden. On the other hand, as illustrated in FIGS. 1 and 2, the recording device 1 according to the example is provided with the two replacement positions for the recording heads 4. With this configuration, the recording heads 4 placed on the back side as viewed from a position of the operator M on one side can be replaced on an opposite side to the one side. Here, the position (the opposite side to the home position side) for the carriage 2 represented by the dashed lines in FIGS. 1 and 2 is referred to as a first replacement position, and the position (the home position side, further outside the home position) for the carriage 2 represented by the solid lines in FIGS. 1 and 2 is referred to as a second replacement position.

In summary, the recording device 1 according to the example includes the carriage 2 configured to reciprocate relative to a medium, and the plurality of recording heads 4 attached to the carriage 2 and configured to discharge ink onto the medium. At the plurality of replacement positions (first replacement position and second replacement position) in the reciprocation direction B of the carriage 2, the carriage 2 allows the recording heads 4 to be replaced. At the replacement positions for the carriage 2, the recording heads to be replaced are accessible from the downstream side (from below) in the discharging direction C of the ink.

With this configuration, the recording heads 4 can be replaced at either of the first replacement position and the second replacement position, whichever allows easy replacement. By accessing (in the example, screwing) the recording heads 4 from the downstream side in the discharging direction C of the ink, the recording heads 4 are accessible from either of the positions, where obstructing parts are few. Therefore, in the carriage 2 attachable with the plurality of recording heads 4, a burden in replacing the recording heads 4 can be reduced. With the configuration where the recording heads 4 are accessible from the downstream side (from below) in the discharging direction C of the ink, the recording heads 4 can be arranged in a highly dense manner, reducing the carriage 2 in size. For example, in a configuration where the recording heads 4 are arranged in a highly dense manner, and screwed from the upstream side (from above) in the discharging direction C of the ink, gaps between the recording heads 4 narrow, reducing a space for inserting a tool for screwing, and making the screwing difficult.

Note that, "the recording heads 4 to be replaced are accessible from the downstream side in the discharging direction C of the ink" refers to both a case when the recording heads 4 to be replaced are accessible from the downstream side in the discharging direction C of the ink, and a case when, as can be seen in the recording device 1 according to the example, the recording heads 4 to be replaced are accessible from a direction other than from the downstream side in the discharging direction C of the ink. The configuration where the recording heads 4 to be replaced are accessible from the downstream side in the discharging direction C of the ink is, for example, a configuration where the recording heads 4 can be inserted into the carriage 2 from below, and then the recording heads 4 can be secured to the carriage 2 from below. Further, "accessing the recording heads 4" refers to, in addition to directly accessing the recording heads 4 to replace the recording heads 4, indirectly accessing the mount 10 and the carriage 2, as with screwing.

In other words, by using the recording device 1 according to the example, which includes the carriage 2 configured to reciprocate relative to a medium, and the plurality of recording heads 4 attached to the carriage 2 and configured to discharge ink onto the medium, a method for replacing discharging units (recording heads 4) can be executed. The method includes moving the carriage 2 to the first replacement position to allow accessing to some of the recording heads 4 from the downstream side in the discharging direction C of the ink for replacement, and moving the carriage 2 to the second replacement position different from the first replacement position to allow accessing to some of the recording heads 4 from the downstream side in the discharging direction C of the ink for replacement.

By executing the method for replacing discharging units, the recording heads 4 can be replaced at either of the first replacement position and the second replacement position, whichever allows easy replacement. By accessing the recording heads 4 from the downstream side in the discharging direction C of the ink, the recording heads 4 are accessible from either of the positions, where obstructing parts are few. Therefore, according to the configuration, in the carriage 2 attachable with the plurality of recording heads 4, a burden in replacing the recording heads 4 can be reduced.

The recording device 1 according to the example is configured to allow accessing (screwing) from the downstream side in the discharging direction C of the ink, and accessing (mounting the recording heads 4 onto the head mount 10) from the upstream side in the discharging direction C of the ink. However, it goes without saying that a configuration may be applied such that the recording heads 4 can be replaced by accessing the recording heads 4 from the downstream side in the discharging direction C of the ink.

As described above, the recording device 1 according to the example is provided with the two replacement positions for the recording heads 4, i.e., the first replacement position on the opposite side to the home position side, and the second replacement position on the home position side. In other words, in the recording device 1 according to the example, the replacement positions are provided on both sides in the reciprocation direction B with respect to a center part within a reciprocation range of the carriage 2. That is, the replacement positions are provided adjacent to both ends in the reciprocation direction B. With this configuration, the recording heads 4 are accessible from either of the positions, where obstructing parts are few, particularly effectively reducing a burden in replacing the recording heads 4.

As described above, in the recording device 1 according to the example, the ink cartridge set part 9 is movable. In other words, in the recording device 1 according to the example, at the replacement positions for the carriage 2, at least one of parts in a position facing the recording heads 4 is movable. With this configuration, when the recording heads 4 are to be replaced, a burden in replacing the recording heads 4 can be reduced by moving the part (ink cartridge set part 9). When the recording heads 4 are not to be replaced, the ink cartridge set part 9 is arranged at a position facing the recording heads 4, achieving space saving in the apparatus.

The recording device 1 according to the example is configured such that, among the replacement positions, the number of replaceable recording heads 4 at the first replacement position, where the part that is movable is present, is greater than the number of replaceable recording heads 4 at the second replacement position, where the part that is movable is not present. By increasing the number of replaceable recording heads 4 at the replacement position where the part that is movable is present to be greater than the number of replaceable recording heads 4 at the replacement position where the part that is movable is not present, the reciprocation range of the carriage 2 can be shortened.

As illustrated in FIG. 1, in the recording device 1 according to the example, at the first replacement position, by moving the ink cartridge set part 9, all of the recording heads 4 are accessible (screwed) from below. At the second replacement position, some of the recording heads 4 are opposite to the home position side, and are not accessible from below. The purpose of this configuration is to suppress the apparatus from increasing in size. When, even at the second replacement position, all of the recording heads 4 are accessible from below, the maintenance part 8, according to the example, being immovable causes the reciprocation range of the carriage 2 on the home position side to extend further outside, increasing the apparatus in size. That is, the recording device 1 according to the example effectively achieves space saving in the apparatus.

In other words, by using the recording device 1 according to the example, allowing, when the carriage 2 is at the first replacement position, at least one part of the parts in a position facing the recording heads 4 to be movable, the method for replacing discharging units can be executed. The method includes increasing the number of recording heads 4 to be replaced at the first replacement position to be greater than the number of recording heads 4 to be replaced at the second replacement position. As described above, by increasing the number of replaceable discharging units (recording heads 4) at the replacement position where the part that is movable is present to be greater than the number of replaceable discharging units (recording heads 4) at the replacement position where the part that is movable is not present, the reciprocation range of the carriage 2 can be shortened. With this configuration, space saving can be effectively achieved in the apparatus.

On the carriage 2 of the recording device 1 according to the example, the recording heads 4 can be detached and attached from the upstream side in the discharging direction C of the ink. The recording heads 4 can then be secured from the downstream side in the discharging direction C of the ink.

Even though, in the recording heads 4, the members, such as flow channels for the ink, are formed on the upstream side in the discharging direction C of the ink, the configuration allowing the recording heads 4 to be secured from the downstream side in the discharging direction C of the ink allows the recording heads 4 to be secured without being obstructed by the members. With the configuration allowing the recording heads 4 to be detached and attached from the upstream side in the discharging direction C of the ink, the recording heads 4 can be easily arranged in a highly dense manner, effectively achieving space saving in the apparatus.

In other words, at the first replacement position and the second replacement position, the method for replacing discharging units can be executed to detach and attach the recording heads 4 from the upstream side in the discharging direction C of the ink, and to secure the recording heads 4 from the downstream side in the discharging direction C of the ink. As described above, by securing the recording heads 4 from the downstream side in the discharging direction C of the ink, the recording heads 4 can be secured without being obstructed by the members on the upstream side in the discharging direction C of the ink, of the recording heads 4. In the recording device 1 according to the example allowing the recording heads 4 to be detached and attached from the upstream side in the discharging direction C of the ink, the recording heads 4 can be easily arranged in a highly dense manner, effectively achieving space saving in the apparatus.

As illustrated in FIGS. 1 to 5, the recording device 1 according to the example includes the driving substrates 3 of the recording heads 4 on both ends on the upstream side and the downstream side in the transporting direction A of the carriage 2. The driving substrates 3 are configured to drive the recording heads 4. By providing the driving substrates 3 on both ends of the carriage 2, the cables 5 can be shortened, compared with a case where the driving substrates 3 are provided on one end alone, suppressing negative effects (e.g., a loss in transmission would be likely to occur, and noise would be likely to be picked up) that occur when the cables are extended longer. The driving substrates 3 are coupled using cables supported by flexible cable support parts to a main substrate (not illustrated) provided to a main body of the recording device 1.

In the recording device 1 according to the example, when the recording heads 4 are to be replaced, and when the recording heads 4 are placed onto the head mount 10, as illustrated in FIG. 1, the operator M accesses to the recording heads 4 from an end side in the reciprocation direction B. In this configuration, the driving substrates 3 are provided on both ends on the upstream side and the downstream side in the transporting direction A of the carriage 2. Therefore, the driving substrates 3 do not interfere replacing the recording heads 4. However, the invention is not limited to the configuration described above. For example, when the recording heads 4 are accessible from a front of the recording device 1, the driving substrates 3 may be provided on both ends in the reciprocation direction B of the carriage 2. In the recording device 1 according to the example, the driving substrates 3 are arranged in two upper and lower rows. However, for example, the driving substrates 3 may be arranged in a single row at ends (four sides) in the transporting direction A and the reciprocation direction B. By totally reducing the driving substrates 3 in height, the recording heads 4 can be easily accessed when replacing the recording heads 4. However, with the configuration described above, it is preferable that the driving substrates 3 be removable when replacing the recording heads 4. With this configuration, the operator M can further easily access the recording heads 4. To allow the operator M to easily access the recording heads 4, the driving substrates 3 may be movable.

Note that the invention is not intended to be limited to the aforementioned examples, and many variations are possible within the scope of the invention as described in the appended claims. It goes without saying that such variations also fall within the scope of the invention.

The entire disclosure of Japanese Patent Application No. 2016-103980, filed May 25, 2016 is expressly incorporated reference herein.

REFERENCE SIGNS LIST

1 . . . Recording device (liquid discharging apparatus), 2 . . . Carriage, 3 . . . Driving substrate, 4 . . . Recording head (discharging unit), 5 . . . Cable, 6 . . . Guide rail, 7 . . . Guide rail, 8 . . . Maintenance part, 9 . . . Ink cartridge set part (part), 10 . . . Head mount, 11 . . . Screw stopper, 12 . . . Support part, 13 . . . Step, 14 . . . Positioning pin, 15 . . . Tube, M . . . Operator

The invention claimed is:

1. A liquid discharging apparatus comprising:

a carriage configured to be reciprocatable relative to a medium; and a plurality of discharging units attached to the carriage and configured to discharge liquid onto the medium, wherein at a plurality of replacement positions in a reciprocation direction of the carriage, the carriage allows the plurality of discharging units to be replaced, and at the plurality of replacement positions for the carriage, a discharging unit to be replaced, among the plurality of discharging units, is accessible from a downstream side in a discharge direction of the liquid, wherein at the plurality of replacement positions for the carriage, at least one of parts in a position facing the plurality of discharging units is movable, and wherein a number of the plurality of discharging units that are replaceable at a replacement position, where the part that is movable is present, among the plurality of replacement positions is greater than a number of the plurality of discharging units that are replaceable at a replacement position, where the part that is movable is not present, among the plurality of replacement positions.

2. The liquid discharging apparatus according to claim 1, wherein the plurality of replacement positions are provided on both sides in the reciprocation direction with respect to a center part within a reciprocation range of the carriage.

3. The liquid discharging apparatus according to claim 1, wherein the carriage allows the plurality of discharging units to be detached and attached from an upstream side in the discharge direction of the liquid, and allows the plurality of discharging units to be secured from the downstream side in the discharge direction of the liquid.

4. A method for replacing a discharging unit, for a liquid discharging apparatus including a carriage configured to reciprocate relative to a medium, and a plurality of discharging units attached to the carriage and configured to discharge liquid onto the medium, the method comprising:

moving the carriage to a first replacement position to allow accessing to some of the plurality of discharging units from a downstream side in a discharge direction of the liquid for replacement; and moving the carriage to a second replacement position different from the first replacement position to allow accessing to some of the plurality of discharging units from the downstream side in the discharge direction of the liquid for replacement, wherein when the carriage is at the first replacement position, at least one of parts in a position facing the plurality of discharging units is movable, and a number of the plurality of discharging units to be replaced at the first replacement position is greater than a number of the plurality of discharging units to be replaced at the second replacement position.

5. The method for replacing a discharging unit according to claim 4, wherein at the first replacement position and the second replacement position, the plurality of discharging units are detached and attached from an upstream side in the discharge direction of the liquid, and the plurality of discharging units are secured from the downstream side in the discharge direction of the liquid.

* * * * *